United States Patent [19]

Sellman et al.

[11] Patent Number: 4,704,966

[45] Date of Patent: Nov. 10, 1987

[54] METHOD OF FORMING IR SMOKE SCREEN

[75] Inventors: Leonard R. Sellman, Anne Arundel; Janon F. Embury, Jr.; Werner W. Beyth, both of Baltimore, all of Md.

[73] Assignee: AAI Corporation, Cockeysville, Md.

[21] Appl. No.: 863,765

[22] Filed: May 16, 1986

[51] Int. Cl.[4] ..... C06D 3/00

[52] U.S. Cl. ..... 102/334; 102/505; 102/506

[58] Field of Search ..... 102/334, 505, 506

[56] References Cited

U.S. PATENT DOCUMENTS

| | | | |
|---|---|---|---|
| 3,860,199 | 1/1975 | Dunne | 102/513 X |
| 3,862,865 | 1/1975 | McManus et al. | 102/358 X |
| 3,898,661 | 8/1975 | Kelly et al. | 102/505 X |
| 3,899,975 | 8/1975 | Lawrence | 102/505 X |
| 4,135,455 | 1/1979 | Wallace | 102/505 X |
| 4,406,227 | 9/1983 | Beeker et al. | 102/505 X |
| 4,484,195 | 11/1984 | Shaffer | 102/334 X |

*Primary Examiner*—Peter A. Nelson

*Attorney, Agent, or Firm*—Reginald F. Pippin, Jr.

[57] ABSTRACT

A visual and infrared screening cloud is formed, comprised of an aerosol of fine metal flakes of copper composition, particularly brass, in which the flakes are of submicron thickness and multimicron lateral face dimensions. The cloud is formed by aerosoling a compact generally cohesive mass of copper composition metal flakes of submicron thickness and multimicron lateral dimensions through the action of explosively bursting such compact mass in the atmosphere at the desired cloud location.

8 Claims, 4 Drawing Figures

METHOD OF FORMING IR SMOKE SCREEN

The U.S. Government has a paid-up license in this invention and the right in limited circumstances to require the patent owner to license others on reasonable terms as provided for by the terms of Contract Number DAAK11-79-C-0123.

This invention relates to a visual and infrared screening cloud and to a method of forming such a cloud.

Efforts to develop a screening cloud that will protect military equipment from both visual and infrared detection have been under way for a number of years. Various military vehicles are conventionally equipped with smoke grenades and suitable launchers, such as launching tubes or barrels, singly or in clusters, whereby the grenades are launched to provide a visual screen relative to the vehicle.

It is an object of the present invention to provide a method for dissemination of visual and infrared screening compositions in a manner compatible with current vehicle-mounted smoke grenade launcher systems, so as to form an effective infrared and visual screening cloud.

Screening effectiveness is optimized by bursting in mid-air an HE explosive central burster surrounded by densely compacted special metal flake composition, compatible with HE explosive, enabling the use of a volume-limited device such as an infrared screening grenade which may be launched from a conventional launch tube.

A further object is the forming of a visual and infrared screening cloud of substantial effectiveness.

Still other objects, features and attendant advantages will become apparent from a reading of the following detailed description of an illustrative embodiment and mode of practice of the invention, taken in conjunction with the accompanying Figures of the Drawings, wherein.

Referring now in detail to the Figures of the Drawings, a visual and infrared screening cloud SC is formed in the atmosphere by projecting one or more burstable containers, such as grenades 21, into the atmosphere at the desired location for formation of a screening cloud SC. This may be effected by launching grenades 21 from a screening vehicle, as by use of conventional multiple launch tubes LT in a launcher L mounted on the vehicle.

The screening cloud SC is formed of fine metal flakes F of a copper composition, in which the flakes F are of submicron thickness and multimicron lateral face dimensions. It has been found that copper alloys, such as bronze and brass, provide an effective visual and infrared screening cloud SC, and that an effective aerosoling of such flakes may be accomplished by using copper alloy, particularly brass, flakes generally of a size of the order of approximately 1.5–14 microns in lateral face dimensions of length, width, diameter or the like, and of the order of approximately 0.07–0.27 microns in thickness.

Metal flakes F of copper composition, particularly copper alloys and preferably brass, which are employed as pigments in the printing industry, have been found to be highly suitable for practice of this invention.

These metal flakes F are suitably compacted as by wetting and subsequently drying a desired mass of such flakes F, to form a compact generally cohesive mass of flakes CF, in a configuration which enables ready explosive bursting to effect aerosoling of the flakes in the atmosphere to thereby form the desired screening cloud SC.

Figure 1:
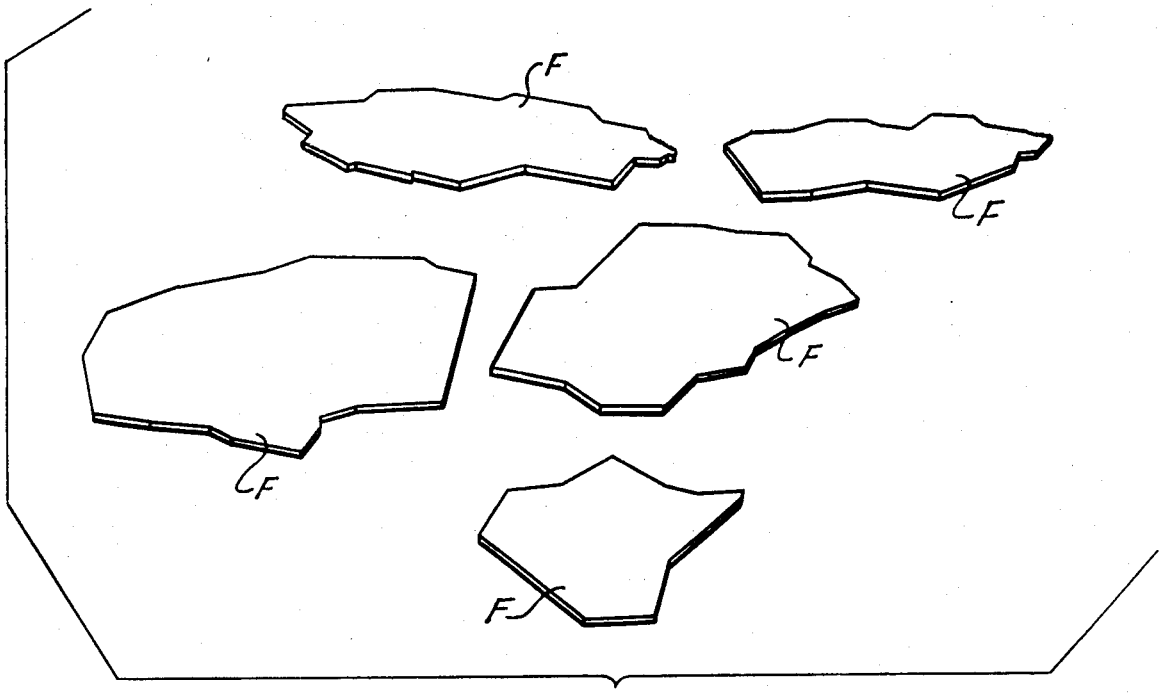
FIG. 1 is a view in perspective of typical random configurations of special flakes employed in the invention.
Figure 2:
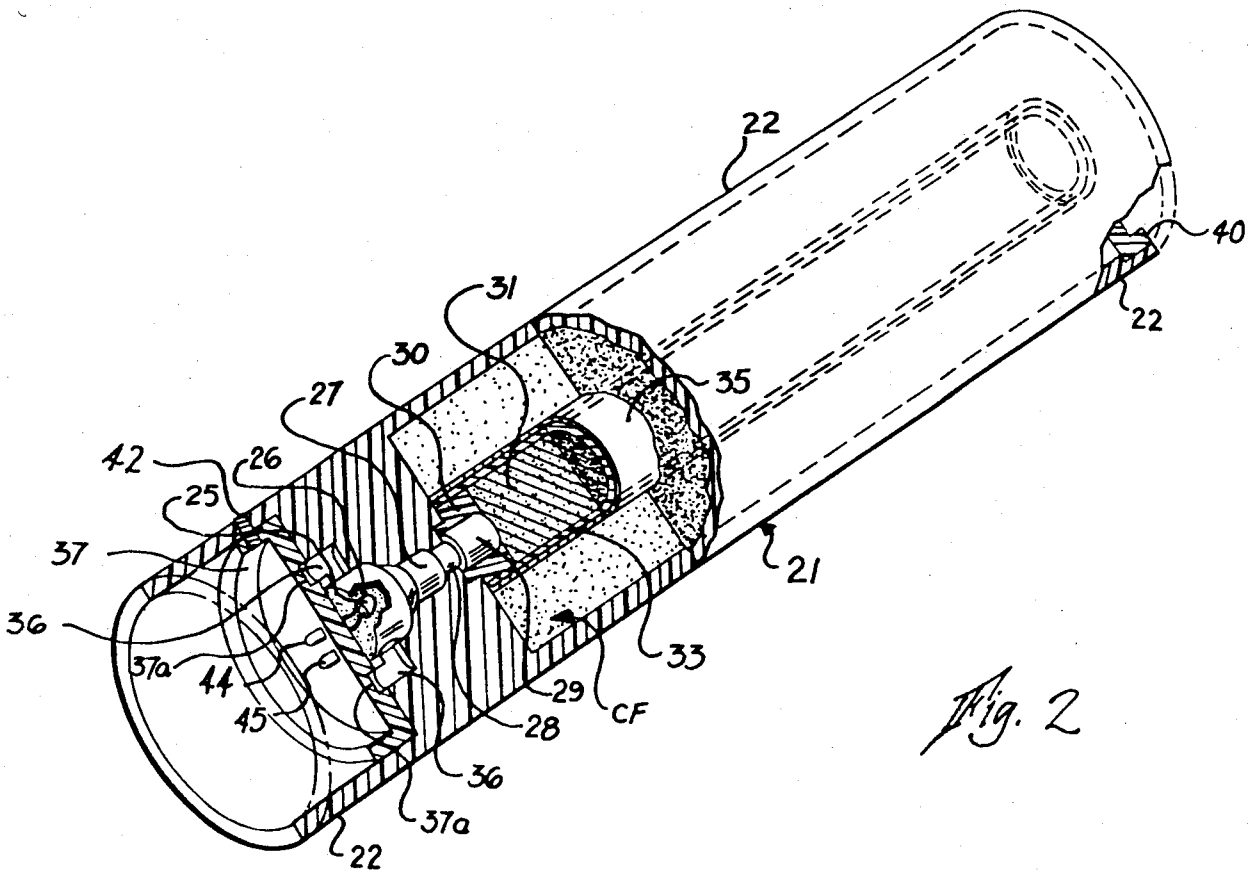
FIG. 2 illustrates, in partial cut-away, a grenade which may be employed for carrying out the method of the invention.

It has been found that a hollow cylindrical or tubular shape is a desirable configuration to enable both adequate bursting of the compact flake mass CF, and also to enable its use in a suitably launchable grenade form as shown at 21 in FIG. 2.

In forming the visual and infrared screening cloud SC, the compacted hollow cylindrical mass of copper alloy flakes CF is explosively burst in the atmosphere by an HE explosive charge mass 31 which is disposed within the hollow cylindrical compacted mass of flakes CF. The term HE explosive is generally accepted as being a composition whose consumption rate is 20,000 feet per second or more.

A ratio of the weight of the compacted mass of metal flakes CF relative to the HE explosive charge mass 31 may be employed within the general range of approximately 20:1 to 60:1, with an optimum ratio being approximately 40:1, particularly for brass flakes CF. This yields maximum visual and infrared screening attenuation over an adequate area to screen the source vehicle SV and surrounding personnel or vehicles from enemy vehicles EV and enemy personnel EP, consistent with grenade volume constraints imposed by launching from a launch tube of desired conventional relatively small size.

A particular advantage of the copper flake composition, particularly copper alloy and preferably brass for the compacted metal flakes CF, is the ability of these flakes to provide a highly effective visual and infrared screening cloud while not flashing or igniting as a result of the explosive bursting of the compact mass CF by the HE explosive 31.

It has been found that clouds of 7 to 10 meters in diameter may be readily formed according to the invention with excellent attenuation throughout the visible and infrared wavelength regions.

Figure 3:
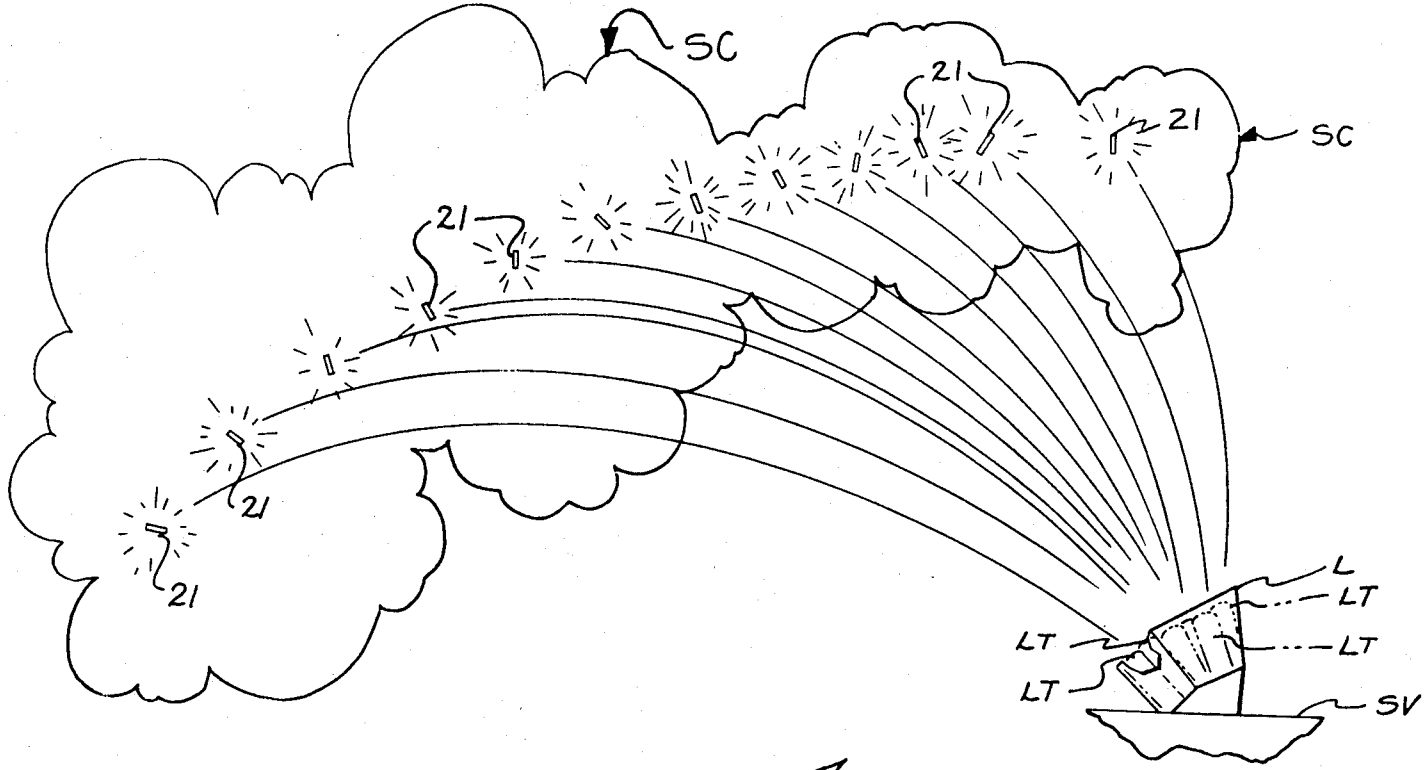
FIGS. 3 and 4 illustrate the forming of multiple screening clouds to form a composite screening cloud according to the invention.
Figure 4:
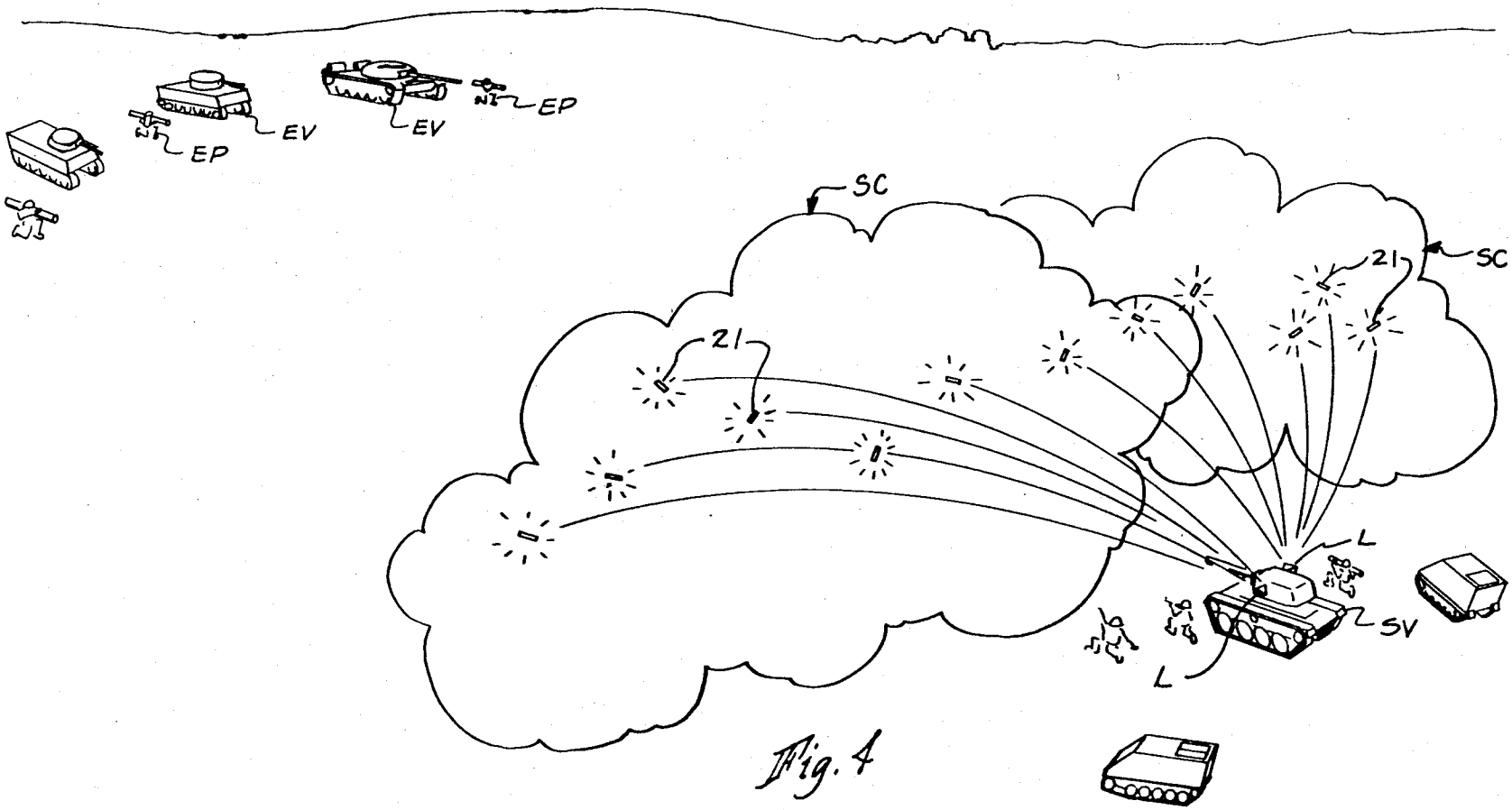

A suitable vehicle for carrying out the method and forming a screening cloud SC according to the invention is generally shown in FIG. 2. In this arrangement, a self-propelled grenade 21 is launchable from a conventional launch tube LT (FIG. 3) mounted on a vehicle or otherwise as desired.

Grenade 21 has a frangible plastic body 22 within which is a hollow cylinder or tube of compacted metal flakes of copper composition CF as previously described. Within the hollow cylindrical mass of metal flakes CF is a cylinder of HE explosive 31, which may be of any conventional HE composition. A guide tube 35 and support tube 33 may be employed between the hollow cylindrical mass CF and the cylindrical HE mass 31, with a plastic cover 40 suitably secured over the end thereof, as by ultrasonic welding.

The grenade is self-propelled by a propellant charge 26 which may be ignited as by an electric squib or electric match 25 and electrical connectors 44, 45, with propellant gases venting rearwardly through side vents 36 leading from the propellant chamber and out through thin-walled blow-outs 37*a* formed in propellant cover 37, having securing pin 42 extending through a lateral wall thereof and through the adjoining wall of body 22.

A suitable pyrotechnic time delay 27 may be ignited directly by the burning propellant 26, immediately connecting therewith, to enable a desired time delay after launch before burst of the HE charge 31.

One or more percussive detonators 28, 29, which may be of successively increasing power, may be employed in the ignition/detonation path leading to the HE mass 31. In the illustrated embodiment, an ignitable relatively low power detonator 28 activates a higher power booster lead 29, which in turn effects explosion of the HE explosive mass 31, to thereby effectively break up and aerosol the fine metal flake mass CF and thus form a desired visual and infrared screening cloud in the atmosphere and the desired location.

By launching multiple grenades 21 from launchers L over a desired area, it will be appreciated that a screening cloud of desired size may be formed so as to screen a relatively wide area from enemy vehicles EV and enemy personnel EP.

While the invention has been illustrated and described with respect to a single illustrative embodiment, it will be appreciated that various modifications and improvements may be made without departing from the scope and spirit of the invention. Accordingly, the invention is not to be limited by the particular illustrative embodiment, but only by the scope of the appended Claims.

We claim:

1. The method of screening against visual and infrared light transmission, comprising injecting into the atmosphere a cloud of fine metal flakes comprised of a copper composition, in which the flakes are of submicron thickness and multimicron lateral face dimensions, said cloud being formed by bursting a compacted generally cohesive solid mass of said metal flakes in the atmosphere to thereby aerosolize and disperse said flakes in the atmosphere.

2. The method according to claim 1, in which said metal flakes are formed of a copper alloy.

3. The method according to claim 1, in which said metal flakes are formed of brass.

4. The method according to claim 3, in which said metal flakes are generally of a size of the order of approximately 1.5–14 microns in lateral face dimensions of length, width, diameter or the like and of the order of approximately 0.07–0.27 microns in thickness.

5. The method according to claim 4, in which said metal flakes are generally oblong and random in size and shape.

6. The method according to claim 1, in which said bursting is effected by bursting an HE explosive charge within said compacted cohesive mass of metal flakes.

7. The method according to claim 6, the ratio of the weights of said compacted cohesive mass of metal flakes relative to said HE explosive charge being within the range of approximately 20:1–60:1.

8. The method according to claim 7, said ratio being approximately 40:1.

* * * * *